US011781402B2

(12) United States Patent
Osthus

(10) Patent No.: US 11,781,402 B2
(45) Date of Patent: Oct. 10, 2023

(54) INTEGRATED TOWHEAD AND FLUID PROCESSING SYSTEM

(71) Applicant: Subsea 7 Norway AS, Stavanger (NO)

(72) Inventor: Arild Osthus, Rennesoy (NO)

(73) Assignee: Subsea 7 Norway AS, Stavanger (NO)

( * ) Notice: Subject to any disclaimer, the term of this patent is extended or adjusted under 35 U.S.C. 154(b) by 0 days.

(21) Appl. No.: 17/264,772

(22) PCT Filed: Aug. 6, 2019

(86) PCT No.: PCT/EP2019/071148
§ 371 (c)(1),
(2) Date: Jan. 29, 2021

(87) PCT Pub. No.: WO2020/035356
PCT Pub. Date: Feb. 20, 2020

(65) Prior Publication Data

US 2021/0246752 A1 Aug. 12, 2021

(30) Foreign Application Priority Data

Aug. 15, 2018 (GB) ..... 1813322

(51) Int. Cl.

| | |
|---|---|
| ***E21B 33/035*** | (2006.01) |
| ***E21B 41/00*** | (2006.01) |
| ***E21B 43/013*** | (2006.01) |
| *B63B 21/66* | (2006.01) |
| *E21B 43/017* | (2006.01) |

(52) U.S. Cl.
CPC ..... *E21B 33/035* (2013.01); *E21B 41/0007* (2013.01); *E21B 43/013* (2013.01); *B63B 21/66* (2013.01); *E21B 43/017* (2013.01)

(58) Field of Classification Search
CPC .. E21B 33/035; E21B 41/0007; E21B 43/013; E21B 43/017; B63B 21/66
USPC ..... 166/344
See application file for complete search history.

(56) References Cited

U.S. PATENT DOCUMENTS

| | | | | |
|---|---|---|---|---|
| 3,987,638 | A | 10/1976 | Burkhardt | |
| 4,120,362 | A | 10/1978 | Chateau et al. | |
| 4,363,566 | A | 12/1982 | Morton | |
| 4,661,127 | A | 4/1987 | Huntley | |
| 8,430,168 | B2 | 4/2013 | Goodall et al. | |
| 9,435,186 | B2 * | 9/2016 | Bakke | E21B 43/01 |
| 10,066,472 | B2 | 9/2018 | Sathananthan et al. | |
| 10,415,350 | B2 | 9/2019 | Radicioni et al. | |

(Continued)

FOREIGN PATENT DOCUMENTS

| | | | | |
|---|---|---|---|---|
| EP | 0 336 492 | | 10/1989 | |
| GB | 2272927 | A * | 6/1994 | E21B 43/017 |

(Continued)

OTHER PUBLICATIONS

Den Boer, A.S. et al., "An Integrated Towed Flowline Bundle Production System for Subsea Developments," OCT-6430-MS, Offshore Technology Conference, May 10, 1990, Houston, Texas.

*Primary Examiner* — Matthew R Buck
*Assistant Examiner* — Patrick F Lambe
(74) *Attorney, Agent, or Firm* — Levy & Grandinetti

(57) ABSTRACT

A subsea processing system has a lattice frame made up of structural members and at least one fluid-processing device. At least one of the structural members effects fluid communication to or from the or each fluid-processing device.

14 Claims, 4 Drawing Sheets

(56) References Cited

U.S. PATENT DOCUMENTS

| | | | | |
|---|---|---|---|---|
| 10,533,399 | B2 | 1/2020 | Ceccon De Azevedo et al. | |
| 2010/0300486 | A1* | 12/2010 | Hoffman | F28G 13/005 134/8 |
| 2012/0138307 | A1 | 6/2012 | Berg | |
| 2015/0345274 | A1 | 12/2015 | Sathananthan et al. | |
| 2019/0137005 | A1* | 5/2019 | Endal | F16L 1/16 |
| 2019/0277116 | A1 | 9/2019 | Halvorsen et al. | |
| 2019/0285219 | A1* | 9/2019 | Pionetti | F16L 53/34 |

FOREIGN PATENT DOCUMENTS

| | | |
|---|---|---|
| GB | 2 396 403 | 6/2004 |
| GB | 2509167 | 6/2014 |
| GB | WO 2016/125114 | 8/2016 |
| WO | WO 85/03544 | 8/1985 |
| WO | WO 2017/000051 | 1/2017 |
| WO | WO 2018/045357 | 3/2018 |

* cited by examiner

INTEGRATED TOWHEAD AND FLUID PROCESSING SYSTEM

This invention relates to subsea structures as used in the subsea oil and gas industry and especially to structures through which fluids will flow in use, such as subsea processing units. The invention relates particularly to the challenge of simplifying such structures so as to reduce their size, weight, material usage and complexity.

A typical subsea oil production system comprises production wells each with a wellhead; pipelines running on the seabed; subsea structures to support valves and connectors; subsea manifolds; and risers to bring production fluids to the surface. At the surface, a topside installation such as a platform or a vessel receives the production fluids before their onward transportation.

Crude oil is a multiphase fluid. Specifically, a wellstream generally contains a mixture of sand, oil, water and gas. Also, the wellstream is hot at the outlet of the wellhead, typically around 200° C. If its temperature decreases below a certain threshold, at a given pressure, components of the wellstream may react together or individually to gel, coalesce, coagulate or precipitate as solid wax, asphaltenes or hydrates. For example, wax will typically appear in oil at a temperature of around 30° C. An accumulation of such solids could eventually plug a pipeline.

A blockage in a subsea pipeline is extremely disruptive and expensive to rectify. It is therefore a common objective to maintain the oil temperature above the critical threshold until the oil has been delivered to a topside installation. There, the oil can be treated to allow the treated oil to be transported at ambient temperature in tankers or in pipelines.

Conventional solutions to maintain oil temperature involve covering a flowline with thermally-insulating materials and/or surrounding the flowline with an outer or carrier pipe as part of a pipe-in-pipe or bundle configuration. Flowlines may also be heated electrically or by heat transfer from hot fluids.

It is also known to transfer at least some conventionally-topside production and storage functions to a subsea location for intermittent export of oil by tanker vessels. By displacing at least some oil processing steps from topside to the seabed, there is less need for thermal insulation or heating of subsea pipelines.

Equipment for processing crude oil or natural gas may be brought together into a self-contained subsea processing unit that simplifies manufacture, transportation and installation. Such a unit is an assembly that, in general terms, comprises: processing equipment; piping; a mechanical support or frame for the equipment and the piping;

and optionally also a foundation. For example, WO 2016/125114 teaches a highly-modular subsea structure in which different items of equipment can be installed separately. U.S. Pat. No. 4,120,362 shows piping arranged over a frame.

Advantageously, a subsea processing unit can be used in conjunction with a pipeline bundle to manage the temperature of production fluids flowing along the bundle. This can involve heating and/or cooling one or more flowlines in the bundle. GB 2396403 exemplifies a pipeline temperature management system.

More generally, a subsea processing unit may be integrated with a pipeline or a pipeline bundle as a towhead disposed at one or both ends of a pipeline or bundle. This allows the pipeline or bundle and towhead(s) to be fabricated and tested onshore and then launched together into the sea to be towed to an installation site.

The or each towhead has valves, connectors and manifolds to facilitate subsea coupling of spool or jumper pipes that integrate the bundle into a production installation when the bundle has been lowered to the seabed. The towheads may also contribute buoyancy to the bundle during tow-out to an installation site.

Various towing methods may be used to transport the pipeline or bundle and towhead(s) to an offshore installation site, at various depths in the water. For example, a favoured mid-water towing method described in U.S. Pat. No. 4,363,566 is known in the art as the 'controlled-depth towing method' or CDTM.

As items of processing equipment such as separators, pumps, valves or tanks are bulky and heavy, a huge structure is required to provide the foundation and mechanical support. In general, the more equipment is needed on a subsea structure, the bigger and the heavier the structure becomes.

Even a simple subsea structure with a few manifolds, as exemplified by U.S. Pat. No. 3,987,638, requires large structural elements. Those structural elements have to be large to withstand the loads experienced during transportation and installation offshore and at depth after installation. For example, vibration, load cycling or drag due to sea dynamics may generate fatigue, and hydrostatic pressure introduces of risk of structural collapse due to crushing. This adds size, weight and cost, and makes transportation and installation more challenging.

One approach to solve this problem is to use different materials for the frame. In particular, composite materials are being used increasingly as structural members in subsea structures. Another approach is to simplify processing equipment and to make that equipment more compact. For example, WO 2017/000051 teaches manufacturing monolithic manifolds that group several valves. However, this can make manufacturing and maintenance more complex.

WO 85/03544 describes a liquid/gas separator capable of being towed to a required location and sunk to a submerged gas pipeline for separating intermittent slugs of liquid. The separator comprises an elongated separator vessel supported by drain pipes above accumulator vessels.

U.S. Pat. No. 8,430,168 describes a testing skid for testing equipment at a subsea location. The skid has a frame and various pieces of equipment that are to be tested are mounted on the frame.

WO 2018/045357 relates to a simplified subsea field in which the umbilical lines are integrated into the flowlines. US 2012/0138307 shows another example of a simplified subsea production system.

The invention proposes an alternative approach to mitigate the problem of weight and bulk.

Against this background, the invention provides a towable subsea structure, comprising: a pipeline or a pipeline bundle; and a subsea processing system in fluid communication with the pipeline or pipeline bundle and being disposed at an end of the pipeline or pipeline bundle, the subsea processing system comprising: a lattice frame made up of structural members to define a towhead; and at least one fluid-processing device; wherein at least one of the structural members effects fluid communication to or from the or each fluid-processing device.

At least one of the structural members could be made of polymer or composite materials.

The or each fluid-processing device is suitably supported by the frame. For example, the or each fluid-processing device may be carried on or contained within at least one structural member of the frame.

Conveniently, at least one of the structural members may define a tank that is in fluid communication with the or each fluid-processing device. In that case, the or each fluid-processing device may be immersed in fluid in the tank. For instance, in an exemplary embodiment to be described, at least one fluid-processing device is an immersion heater in fluid communication with a hot-water heating circuit. The immersion heater may be disposed within at least one of the structural members, which structural member serves as an expansion tank for water heated by the immersion heater.

At least one of the structural members may effect fluid communication between two or more fluid-processing devices.

The frame may comprise upper and lower structural members, in which case at least one of the lower structural members preferably effects fluid communication to or from the or each fluid-processing device.

The frame may comprise longitudinally-extending, substantially parallel tubular structural members, at least one of which is in fluid communication with the or each fluid-processing device.

Structural members of the frame could be in fluid communication with each other, and could be connected in series as part of a fluid circuit.

The inventive concept also embraces a method of processing fluid subsea, the method comprising conveying fluid to or from a fluid-processing device through at least one structural member of a lattice frame that supports the fluid-processing device, wherein the at least one structural member is in fluid communication with a pipeline or a pipeline bundle; and wherein the frame is configured to define a towhead disposed at an end of the pipeline or the pipeline bundle. The method may be preceded by the preliminary step of transporting the frame to a subsea location while providing buoyant support to the frame by holding a gas in said structural member of the frame.

Embodiments of the invention provide a subsea processing system comprising fluid processing or handling devices and a structural frame comprising structural members, wherein at least one of the structural members is used as piping between at least two of the processing or handling devices, for example to carry processed fluid between those devices. The system suitably comprises a foundation or may be mounted on a foundation.

Whilst pipework attached to the structural members of a frame may contribute some minimal structural strength to a subsea processing system, any such contribution is trivial in comparison to the essential structural strength that is provided by the structural members themselves. Consequently, pipework can be distinguished from structural members in that the structure will maintain sufficient structural integrity if a length of pipework is removed but the structure will not maintain sufficient structural integrity if a structural member is removed.

Processing may involve actively changing—thus, intervening to change—the temperature, pressure, flow rate, composition or state of a fluid when producing oil and gas from subsea sources. Such fluids may, for example, be production fluids in a wellstream or water used to heat production fluids.

The structural member may, for example, be a member of a lattice structure and may be based on a polymeric or composite material. Lower or base members of the structure may be of steel and upper members of the structure may be of polymer or composite materials. The structural member may contain at least one conduit in a polymer or composite material.

The processing or handling device may be any one or more of: a separator; a pump; a connector; a valve; a heat exchanger; a storage tank; a heater; a condenser; or an expansion tank.

At least one of the structural members may be in fluid communication with a connector hub for fluidly connecting a processing or handling device.

The structural frame may be used as a heat exchanger for exchanging heat with seawater.

A structural member may itself be used as a processing or handling device.

A structural member may contain a heating element that heats circulating fluid.

The invention may, for example, be embodied as a towhead for a subsea pipeline bundle. Such a towhead may be used for heating fluid circulating in the bundle, in which case the towhead may comprise: at least one hollow structural member containing a heating element; and at least a second structural member used as piping between an outlet of the first structural member and a heating pipe of the bundle. The hollow structural element may, for example, serve as an expansion tank.

In embodiments to be described, the invention allows tubular or hollow structural members of a towhead to be used as expansion tanks or heating chambers for a pipeline bundle that is heated by a hot fluid such as hot water. This avoids the need to add large tanks for expansion and heating of water. Preferably the bottom structural members of the towhead are used for this purpose.

During a towing operation, at least some structural members of the towhead may be filled with air to create positive buoyancy that counterbalances the weight of the towhead. By virtue of the invention, the structural members of the towhead may be used both for buoyancy purposes and as an integral part of the heating system.

In order that the invention may be more readily understood, reference will now be made, by way of example, to the accompanying drawings in which.

Figure 1:
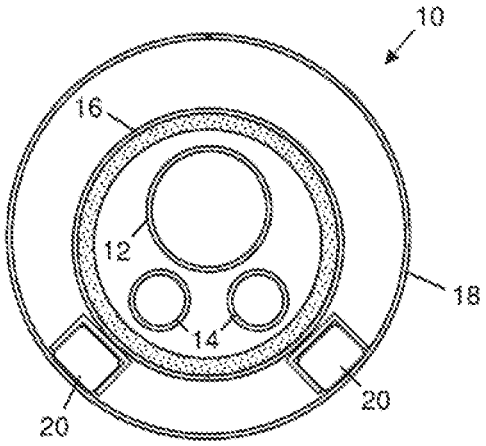
FIG. 1 is a cross-sectional view of a typical subsea pipeline bundle.

FIG. 1 shows a pipeline bundle 10 in transverse cross-section. The bundle 10 comprises a flowline 12 and parallel hot water lines 14, all contained within, and extending along, a thermally-insulated inner carrier pipe 16.

In turn, the inner carrier pipe 16 containing the flowline 12 and the hot water lines 14 is contained within, and extends along, an outer carrier pipe 18. Rollers 20 support the inner carrier pipe 16 for longitudinal movement relative to an outer carrier pipe 18, as will occur on assembly of the bundle 10 and under differential thermal expansion in use.

The bundle 10 is an example of many possible bundle arrangements. It shows one way in which production fluid can be kept warm by transfer of heat from one or more hot fluid lines such as the hot water lines 14 to an adjacent flowline 12.

In this example, the hot water lines 14 lie parallel to each other as a pair but are fluidly connected in series to serve as parts or legs of the same hot fluid loop or circuit. Thus, the flow direction in one hot water line 14 is the reverse of the flow direction in the other hot water line 14.

Figure 2:
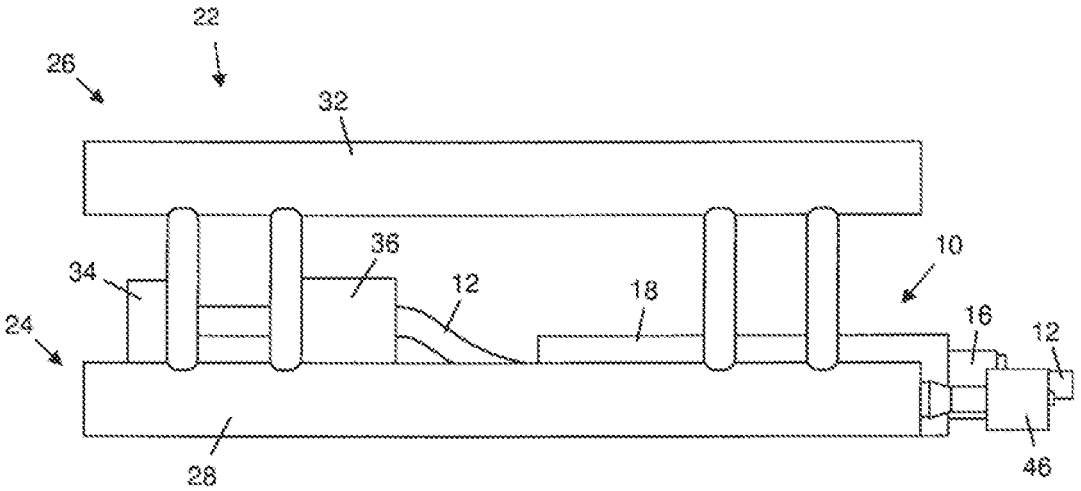
FIG. 2 is a schematic side view of a towhead of the invention attached to an end of the bundle shown in FIG. 1.

FIG. 2 shows a towhead 22 at an end of the bundle 10. The towhead 22 has a lattice structure that comprises a base frame 24 and an upper frame 26 spaced from the base frame 24. The upper frame 26 stiffens the structure of the towhead 22 and encloses and protects equipment carried by the base frame 24. These parts of the towhead 22 would conventionally be fabricated of steel but one or more structural members of the towhead 22 could be of polymer or composite materials.

Figure 3:
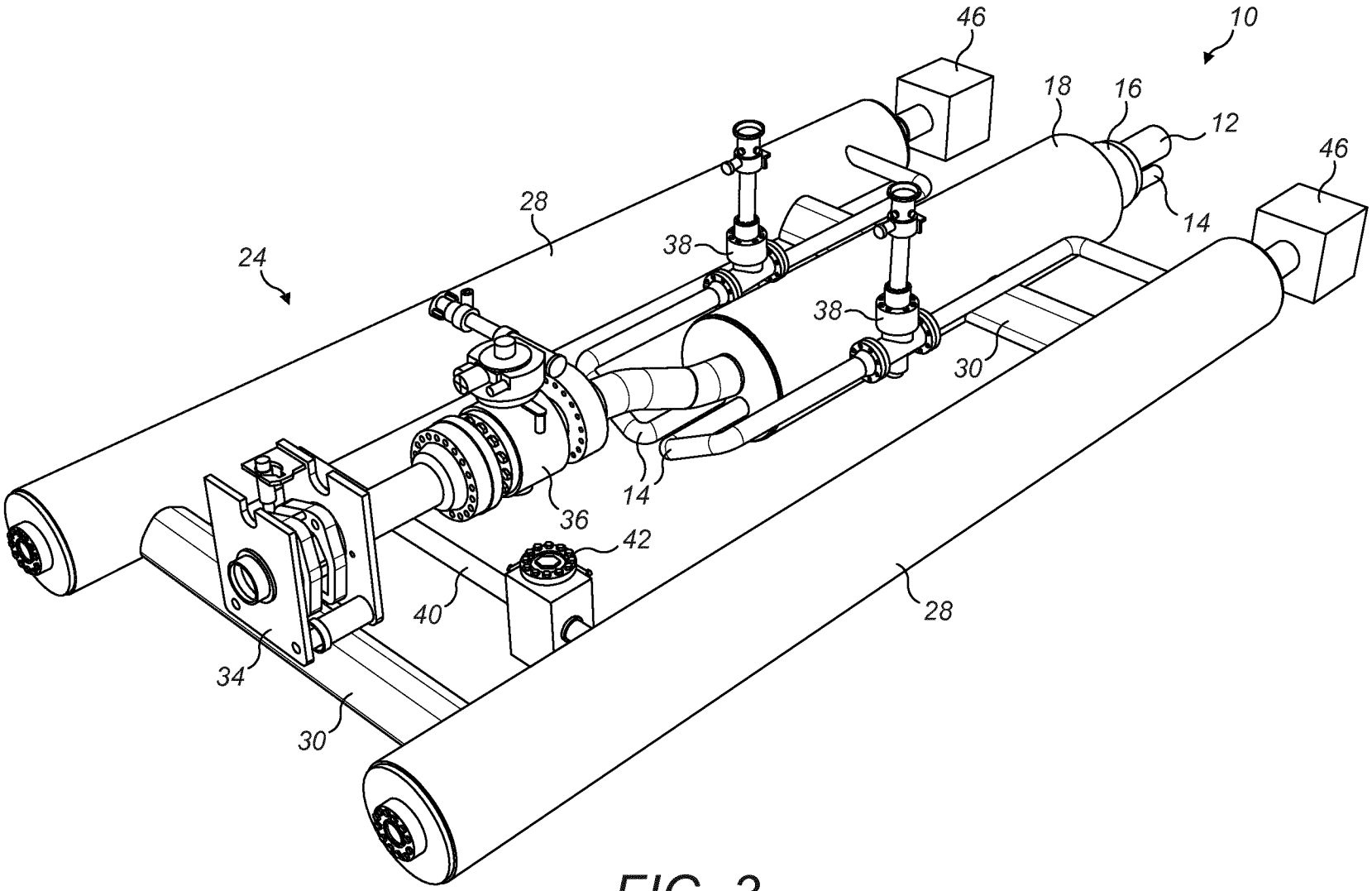
FIG. 3 is a cut-away perspective view showing a base frame of the towhead shown in FIG. 2 at an end of the bundle.
Figure 4:
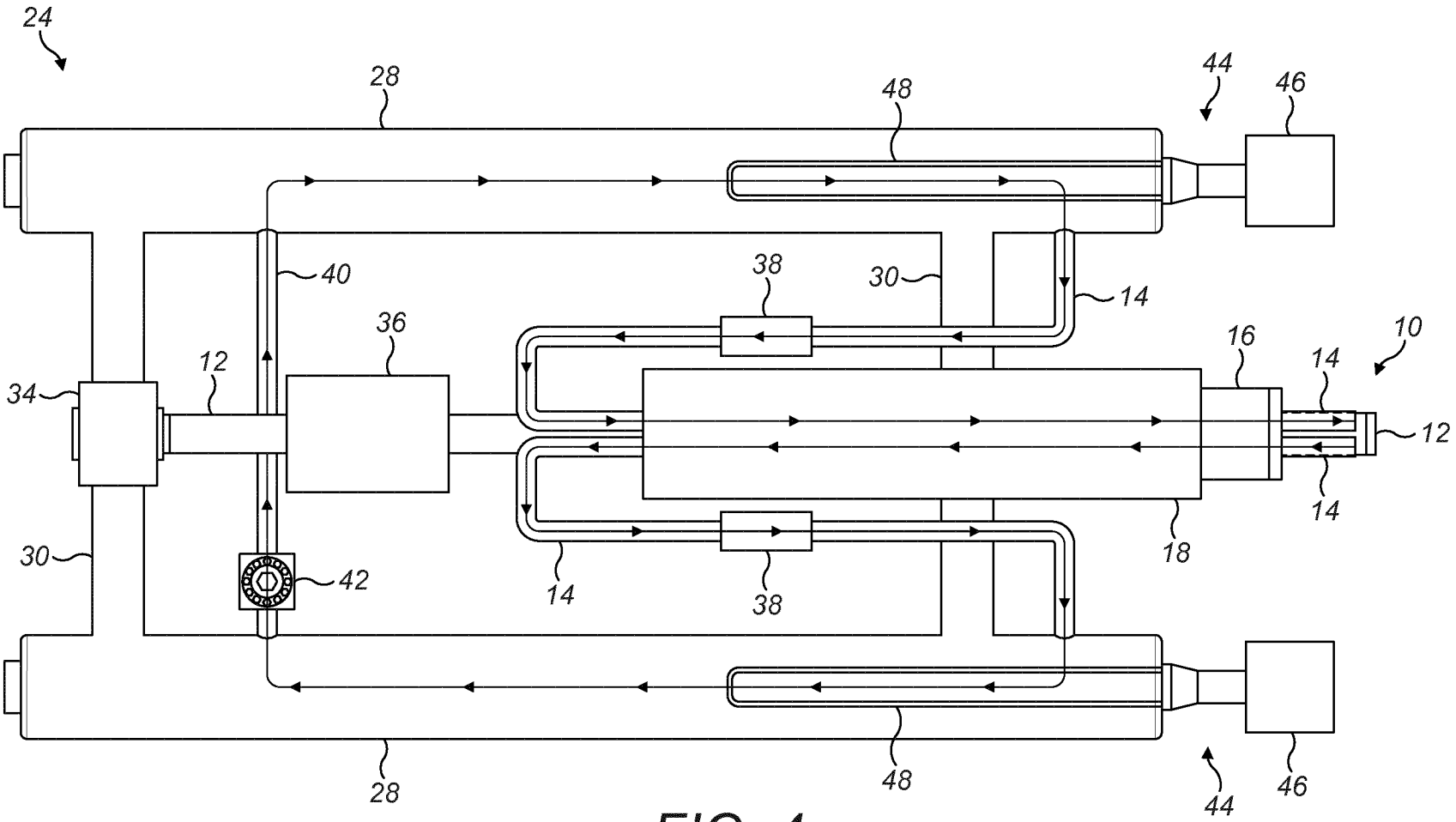
FIG. 4 is a schematic outline of the base frame of FIG. 3 in top plan view, showing hot water circulation through the bundle and the base frame in accordance with the invention.

The base frame 24 is shown in detail in FIG. 3 and in outline in FIG. 4. Only the main structural members of the base frame 24 are shown in FIGS. 3 and 4, namely parallel longitudinal tubes 28 and tubular cross-members 30 that join the tubes 28. An end portion of the bundle 10 lies centrally between and extends parallel to the tubes 28.

In this example, the cross-members 30 extend orthogonally to the tubes 28 so that the base frame 24 has a ladder configuration. The base frame 24 could instead have a triangulated configuration in which cross-members 30 are at acute angles to the tubes 28.

The upper frame 26 comprises upper tubes 32 that extend parallel to the tubes 28 of the base frame 24 and may also be of ladder or triangulated configuration.

The bundle 10 is connected to the towhead 22 mechanically and also to establish fluid communication between the bundle 10 and the towhead 22. In this example, the connections between the bundle 10 and the towhead 22 are made via the base frame 24.

Specifically, the base frame 24 is arranged and equipped to receive production fluid from the flowline 12 or to convey production fluid to the flowline 12. The base frame 24 is also arranged and equipped to receive water from the hot water lines 14, to heat that water, to output the heated water back into the hot water lines 14 and to drive circulation of the water along the hot water lines 14.

The end portion of the bundle 10 is attached to and supported by one of the cross-members 30 near one end of the base frame 24. A typically welded interface between the outer carrier pipe 18 of the bundle 10 and the cross-member 30 effects mechanical coupling between the bundle 10 and the base frame 24.

The other cross-member 30 near the other end of the base frame 24 supports a tie-in porch 34. The flowline 12 emerges from a closed end of the outer carrier pipe 18 of the bundle 10 and extends along the base frame 24 to the tie-in porch 34 via a production check valve 36.

As noted above, the hot water lines 14 are parts of the same hot fluid loop or circuit. In accordance with the invention, that circuit includes structural members of the base frame 24, in this example the tubes 28, which serve as flow conduits, reservoirs and/or expansion tanks for hot water. Thus, the hot water lines 14 emerge from the end of the bundle 10 and extend from the bundle 10 in respective opposite lateral directions to connect to respective ones of the tubes 28 for fluid communication with the tubes 28.

Each hot water line 14 has a respective hot water check valve 38 disposed between the bundle 10 and the associated tube 28.

The hot fluid loop or circuit is completed by a cross-pipe 40 that extends between and couples the tubes 28 for fluid communication between them. A hot water pump 42 in the cross-pipe 40 drives the flow of hot water through the hot fluid circuit.

Each tube 28 is equipped with electrically-powered immersion heaters 44 for heating water as it resides within and flows along the tubes 28. Power units 46 of the immersion heaters 44 conveniently protrude from ends of the respective tubes 28. As shown in FIG. 4 of the drawings, heating elements 48 of the immersion heaters 44 extend from the power units 46 along the interior of the tubes 28.

FIG. 4 also shows the path of hot water circulation around the system. Water returning from the bundle 10 along one of the hot water pipes 14 emerges from the bundle 10 and enters one of the tubes 28, where the water is heated by the associated heating element 48. The heated water flows along that tube 28 and then along the cross-pipe 34 and into the other tube 28, where the water is heated further by the heating element 48 associated with that other tube 28. The further-heated water flows along that other tube 28 and then back into the bundle 10 along the other hot water pipe 14.

Figure 5:
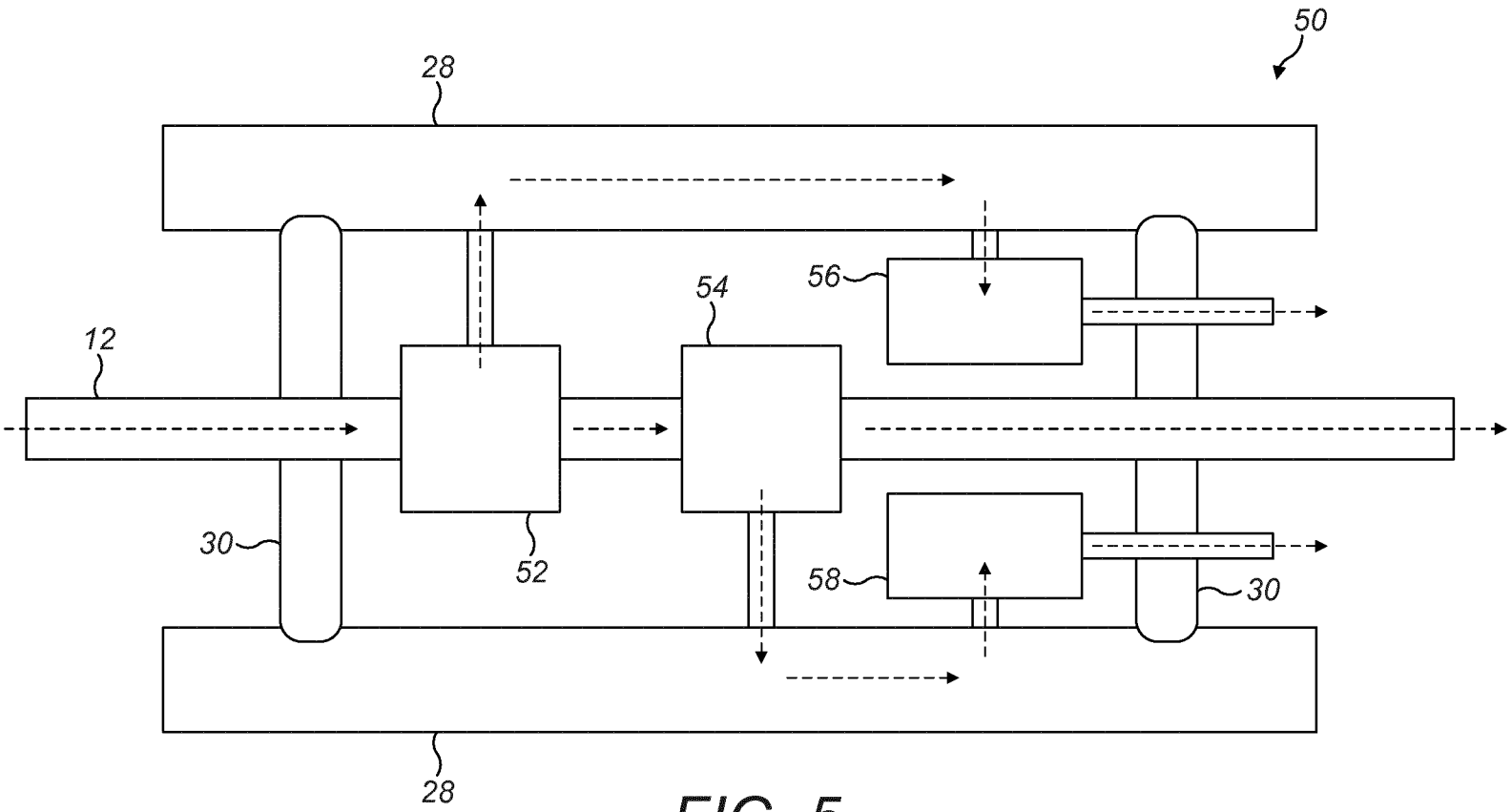
FIG. 5 is a schematic outline of a base frame of a towhead in top plan view, showing a further embodiment of the invention applied to processing of production fluid in a wellstream.

Turning finally to FIG. 5, this exemplifies how the inventive concept may be applied to processing of production fluid in a wellstream. As in FIG. 4, arrows show the various fluid flow paths. Like numerals are used for like features.

Here, a base frame 50 of a towhead or other subsea structure again comprises parallel longitudinal tubes 28 and tubular cross-members 30 that join the tubes 28. In this example, the base frame 50 supports a gas separator 52 and a water separator 54 that are connected in series to remove gas and then water from a wellstream. For this purpose, the gas separator 52 and the water separator 54 communicate with a flowline 12 that carries the incoming wellstream.

Gas removed from the wellstream by the gas separator 52 is held in, and conveyed along, one of the tubes 28 of the base frame 50 to a pump 56 that pressurises the gas, for example for re-injection into a subsea well.

Oily water removed from the wellstream by the water separator 54 is held in, and conveyed along, the other tube 28 of the base frame 50 to a treatment unit 58. The treatment unit 58 cleans the water by removing residual oil, allowing the water to be re-injected into a well or to be expelled into the surrounding sea.

Typically, control valves will be interposed between the flowline 12 and the tubes 28 and/or between the tubes 28 and the pump 56 and the treatment unit 58. Such valves have been omitted from FIG. 5 for simplicity.

FIG. 5 shows that different structural members of a subsea structure may be used to hold or to convey different fluids. More generally, using structural members of the subsea structure to hold and/or to convey fluids simplifies and lightens the assembly by reducing pipework and by obviating holding tanks. Also, by providing more options to position functional modules space-efficiently, the assembly can be made more compact.

Many variations are possible within the inventive concept. For example, hot gases such as steam or fluids or liquids other than water could be circulated in the system.

Fluid communication between the tubes 28 could be effected via one or more structural cross-members 30 rather than via separate piping such as the cross-pipe 40. The hot water pump 42 could be positioned elsewhere in the hot fluid circuit.

Only one tube 28 or other structural member could be used to heat or to convey fluids; conversely, more than two tubes 28 or other structural members could be used to heat or to convey fluids.

The invention claimed is:

1. A towable subsea structure, comprising:

a pipeline or a pipeline bundle; and a subsea processing system in fluid communication with the pipeline or pipeline bundle and being disposed at an end of the pipeline or pipeline bundle, the subsea processing system comprising:

a lattice frame defining a towhead, the lattice frame comprising an upper frame and a base frame each made up of structural members configured to maintain sufficient structural integrity of the towable subsea structure; and at least one fluid-processing device supported by the lattice frame;

wherein structural members of the base frame are in fluid communication with each other and at least one of the structural members of the base frame effects fluid communication to or from the or each fluid-processing device.

2. The structure of claim 1, wherein the or each fluid-processing device is carried on at least one structural member of the frame.

3. The structure of claim 1, wherein the or each fluid-processing device is contained within at least one structural member of the frame.

4. The structure of claim 1, wherein at least one of the structural members defines a tank in fluid communication with the or each fluid-processing device.

5. The structure of claim 4, wherein the or each fluid-processing device is immersed in fluid in the tank.

6. The structure of claim 1, wherein at least one of the structural members effects fluid communication between two or more fluid-processing devices.

7. The structure of claim 1, wherein at least one of the structural members of the base frame is in fluid communication with the pipeline or pipeline bundle.

8. The structure of claim 1, wherein at least one of the structural members of the lattice frame is made of polymer or composite materials.

9. The structure of claim 1, wherein the or each fluid-processing device is an immersion heater in fluid communication with a hot-water heating circuit.

10. The structure of claim 9, wherein the immersion heater is disposed within at least one of the structural members of the lattice frame, which structural member serves as an expansion tank for water heated by the immersion heater.

11. The structure of claim 1, wherein the base frame comprises longitudinally-extending, substantially parallel tubular structural members.

12. The structure of claim 11, wherein the longitudinally-extending, substantially parallel tubular structure members of the base frame are connected in series as part of a fluid circuit.

13. A method of processing fluid subsea, comprising conveying fluid to or from a fluid-processing device through at least one structural member of a base frame a lattice frame that supports the fluid-processing device wherein the at least one structural member of the base frame is in fluid communication with a pipeline or a pipeline bundle and with another structural member of the base frame; and wherein the frame is configured to define a towhead disposed at an end of the pipeline or the pipeline bundle and the structural members are configured to maintain sufficient structural integrity of the towhead.

14. The method of claim 13, preceded by transporting the frame to a subsea location while providing buoyant support to the frame by holding a gas in said structural member of the frame.

* * * * *